US010384457B2

(12) United States Patent
Tsuji et al.

(10) Patent No.: US 10,384,457 B2
(45) Date of Patent: Aug. 20, 2019

(54) LIQUID EJECTION HEAD UNIT AND LIQUID EJECTING APPARATUS

(71) Applicant: CANON KABUSHIKI KAISHA, Tokyo (JP)

(72) Inventors: Tomoki Tsuji, Naka-gun (JP); Toshiaki Hirosawa, Hiratsuka (JP); Hiromasa Amma, Kawasaki (JP); Takuya Iwano, Inagi (JP); Akira Kida, Yokohama (JP); Tetsuji Kurata, Yokohama (JP); Atsushi Kohnotoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/025,384

(22) Filed: Jul. 2, 2018

(65) Prior Publication Data

US 2019/0009542 A1 Jan. 10, 2019

(30) Foreign Application Priority Data

Jul. 7, 2017 (JP) ..... 2017-133992

(51) Int. Cl.

*B41J 2/175* (2006.01)
*B41J 2/165* (2006.01)
*B41J 29/12* (2006.01)

(52) U.S. Cl.

CPC ..... *B41J 2/17533* (2013.01); *B41J 2/16505* (2013.01); *B41J 2/16508* (2013.01); *B41J 2/16511* (2013.01); *B41J 2/16585* (2013.01); *B41J 2/17536* (2013.01); *B41J 29/12* (2013.01); *B41J 2002/16502* (2013.01); *B41J 2202/21* (2013.01)

(58) Field of Classification Search

CPC B41J 2/16585; B41J 2202/21; B41J 2/16511; B41J 2/16508; B41J 2/16505; B41J 29/12; B41J 2002/16502; B41J 2/17533; B41J 2/17536

See application file for complete search history.

(56) References Cited

U.S. PATENT DOCUMENTS

2007/0109350 A1* 5/2007 Izawa ..... B41J 29/02 347/37
2017/0326875 A1 11/2017 Nakakubo et al.
(Continued)

FOREIGN PATENT DOCUMENTS

JP 2002-321377 A 11/2002

*Primary Examiner* — Geoffrey S Mruk
(74) *Attorney, Agent, or Firm* — Venable LLP

(57) ABSTRACT

A liquid ejection head unit includes a page-wide type liquid ejection head detachably attached to a liquid ejecting apparatus and a protective member detachably attached to the liquid ejection head. The liquid ejection head includes an ejection port surface on which ejection ports are provided. The liquid ejection head includes a first rail portion, the protective member includes a second rail portion along a longitudinal direction thereof, and the protective member is made to slide in a first direction along the longitudinal direction of the liquid ejection head and cover the ejection port surface. The protective member is attached to the liquid ejection head, and then the liquid ejection head and the protective member are moved in a second direction opposite to the first direction and are removed from the liquid ejecting apparatus.

9 Claims, 12 Drawing Sheets

(56) References Cited

U.S. PATENT DOCUMENTS

| | | | |
|---|---|---|---|
| 2018/0086064 | A1 | 3/2018 | Kimura et al. |
| 2018/0361748 | A1 | 12/2018 | Inada et al. |
| 2019/0009540 | A1 | 1/2019 | Iwano et al. |

* cited by examiner

LIQUID EJECTION HEAD UNIT AND LIQUID EJECTING APPARATUS

BACKGROUND OF THE INVENTION

Field of the Invention

The present disclosure relates to a liquid ejection head unit and a liquid ejecting apparatus.

Description of the Related Art

Japanese Patent Application Laid-Open No. 2002-321377 discloses an inkjet recording apparatus including a liquid ejection head and a recovering device. Here, the liquid ejection head has a nozzle for ejecting an ink droplet on a recording medium and is detachably attached to a main body of the inkjet recording apparatus. Moreover, the recovering device has a protective cap member covering an ejection port surface of the nozzle when the liquid ejection head is not mounted and carries out an appropriate recovering action in contact with the ejection port surface in the nozzle of the liquid ejection head. In this inkjet recording apparatus, the liquid ejection head is replaced while the protective cap member is mounted.

When the liquid ejection head is removed from the main body of the liquid ejecting device with the ejection port of the liquid ejection head exposed, problems occur such as scattering of the ink from the ejection port, a failure caused by the contact with the liquid ejection head, and ink contamination at replacement. In the case of the configuration disclosed in Japanese Patent Application Laid-Open No. 2002-321377, these problems can be solved.

However, in the configuration disclosed in Japanese Patent Application Laid-Open No. 2002-321377, the protective cap member is included in replacement components (removed components) when the liquid ejection head is replaced. Thus, there is a problem that a size of the replacement components becomes larger by a portion including the protective cap member. This problem becomes particularly remarkable when the size of the liquid ejection head is large such as a page-wide type liquid ejection head.

SUMMARY OF THE INVENTION

This disclosure has an object to provide a small-sized liquid ejection head unit capable of being removed from a main body without exposing an ejection port when the liquid ejection head is removed from a liquid ejecting apparatus.

A head unit of this disclosure is a liquid ejection head unit including a page-wide type liquid ejection head including an ejection port surface on which an ejection port for ejecting a liquid is provided, the liquid ejection head being detachably attached to a liquid ejecting apparatus, and a protective member detachably attached to the liquid ejection head, in which the liquid ejection head includes a first rail portion along a longitudinal direction of the liquid ejection head, the protective member includes a second rail portion along a longitudinal direction of the protective member, the second rail portion of the protective member is brought into contact with the first rail portion of the liquid ejection head mounted on the liquid ejecting apparatus, the ejection port surface is covered by sliding the protective member in a first direction along the longitudinal direction of the liquid ejection head, and after the protective member is attached to the liquid ejection head, the liquid ejection head and the protective member are both moved in a second direction opposite to the first direction to be removed from the liquid ejecting apparatus.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An embodiment of the present invention and its variations will be described below in a description order of them. A liquid ejection head of this disclosure for ejecting a liquid such as ink and a liquid ejecting apparatus on which the liquid ejection head is mounted can be applied to apparatuses such as a printer, a copying machine, a facsimile machine having a communication system and a word processor having a printer portion. Moreover, it can be applied to an industrial recording apparatus integrally combined with various processing devices. For example, it can be used for applications such as a biochip preparation, electronic circuit printing, semiconductor substrate fabrication and a 3D printer.

This Embodiment

This embodiment will be described below by referring to the attached drawings. First, an entire configuration of a liquid ejecting apparatus 1000 (see FIGS. 1A to 2) of this embodiment will be described. Then, a configuration of a liquid ejection head unit 2 (see FIGS. 3A to 3E and the like) of this embodiment will be described. Then, a removal (taking-out) operation and an effect of the liquid ejection head 3 (or a liquid ejection head unit 2) will be described.

[Entire Configuration of Liquid Ejecting Apparatus]

Figure 1A:
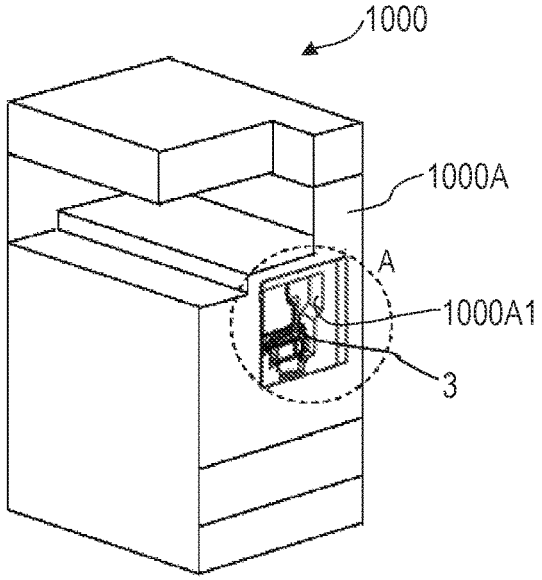
FIGS. 1A and 1B are a perspective view and an enlarged view of a part of a liquid ejecting apparatus of this embodiment.
Figure 1B:
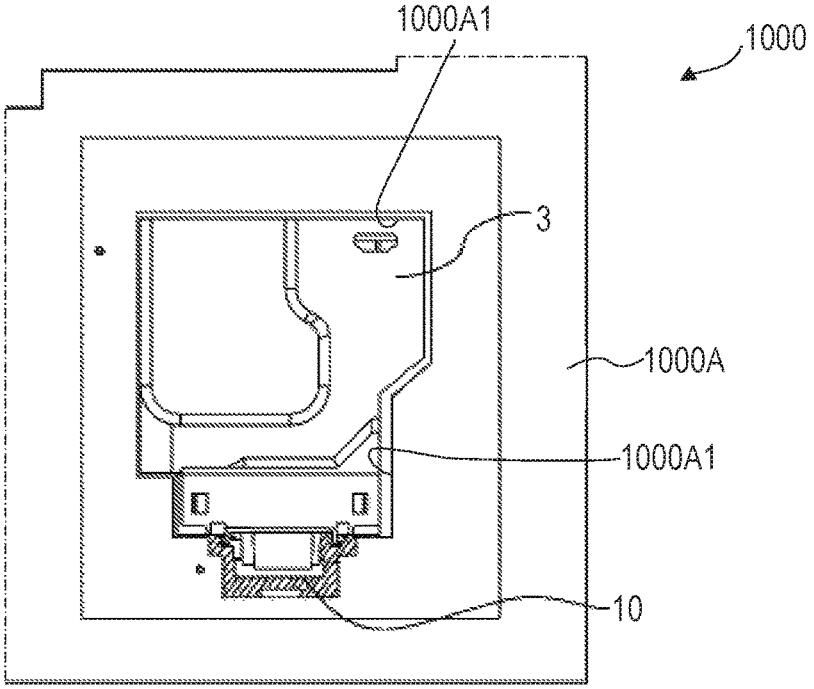
Figure 2:
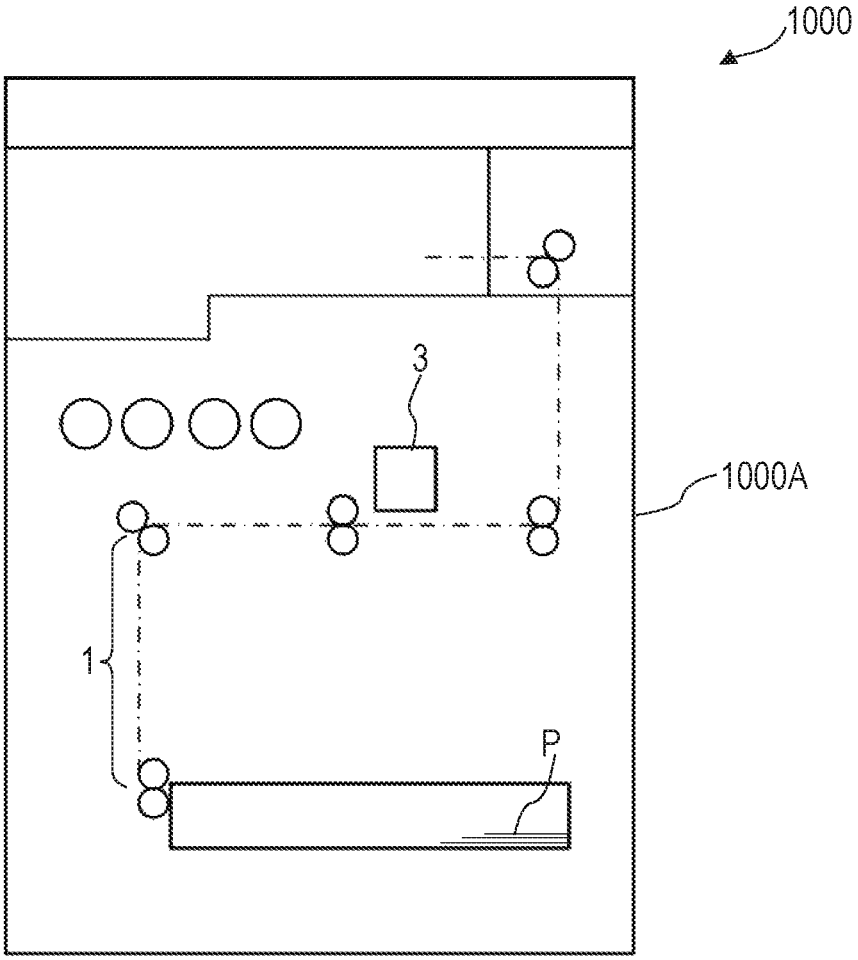
FIG. 2 is a schematic diagram of the liquid ejecting apparatus of this embodiment.

FIG. 1A illustrates a perspective view of a state where a liquid ejection head 3 is mounted on a main body 1000A of a liquid ejecting apparatus 1000 and FIG. 1B illustrates an enlarged view of an A part (part surrounded by a broken line part) in FIG. 1A. FIGS. 1A to 2 illustrate an apparatus for ejecting a liquid in this embodiment or specifically, an inkjet recording apparatus 1000 (hereinafter referred to as the liquid ejecting apparatus 1000) which ejects an ink (an example of the liquid) for recording. The liquid ejecting apparatus 1000 includes a conveyance portion 1 for conveying a recording medium P (see FIG. 2, hereinafter referred to as a medium P.), a liquid ejection head 3 (lengthy page-wide type head) disposed substantially orthogonal to a conveyance direction of the medium P and a recovery cap (not shown). The recovery cap is to suppress evaporation of the ink by covering an ejection port surface of the liquid ejection head 3 while a recording operation is not carried out, for example, and is arranged on a lower side of the liquid ejection head 3. If the recovery cap exerts the aforementioned function, the arrangement does not have to be on the lower side of the liquid ejection head 3. The liquid ejecting apparatus 1000 is assumed to be a page-wide type liquid ejecting apparatus for carrying out continuous recording in a single pass while the medium P is conveyed continuously or intermittently.

The liquid ejection head 3 together with a protective member 5 are detachably attached to the main body 1000A (a portion excluding the liquid ejection head 3) configuring the liquid ejecting apparatus 1000. That is, the liquid ejection head unit 2 including the liquid ejection head 3 and the protective member 5 is detachable with respect to the main body 1000A. Thus, an opening 1000A1 (see FIG. 1B, FIGS. 6A and 6B) for attaching or removing the liquid ejection head unit 2 is formed in the main body 1000A. Moreover, in this embodiment, the ink is described as an example of the liquid ejected from the liquid ejection head 3, but an example of the liquid may be those other than the ink.

The liquid ejecting apparatus 1000 is capable of full-color printing by ejecting ink in each of C (cyan) color, M (magenta) color, Y (yellow) color and K (black) color from the liquid ejection head 3. A liquid supply unit which is a supply path for supplying the liquid to the liquid ejection head, a main tank and a buffer tank (not shown) are mechanically connected to the liquid ejection head 3. Moreover, an electric control portion for transmitting power and ejection control signals to the liquid ejection head 3 is electrically connected to the liquid ejection head 3. The medium P is not limited to cut sheets but may be a continuous rolled sheet.

[Configuration of Liquid Ejection Head]

Figure 4A:
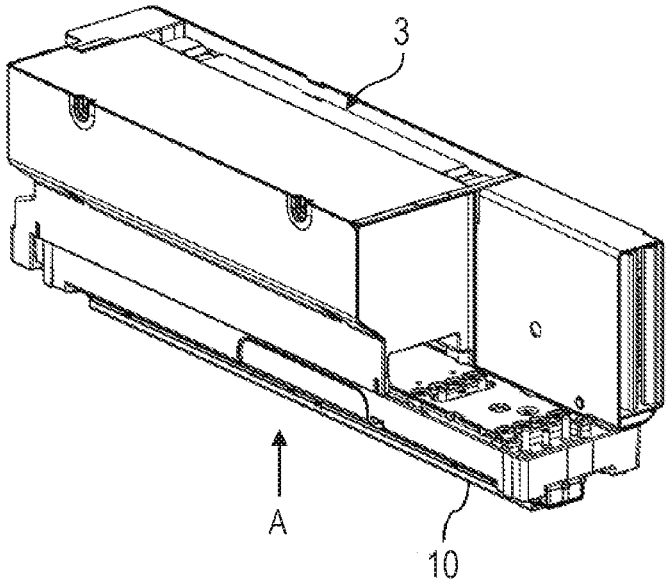
FIGS. 4A and 4B are a perspective view and an A-arrow view of the liquid ejection head of the embodiment.
Figure 4B:
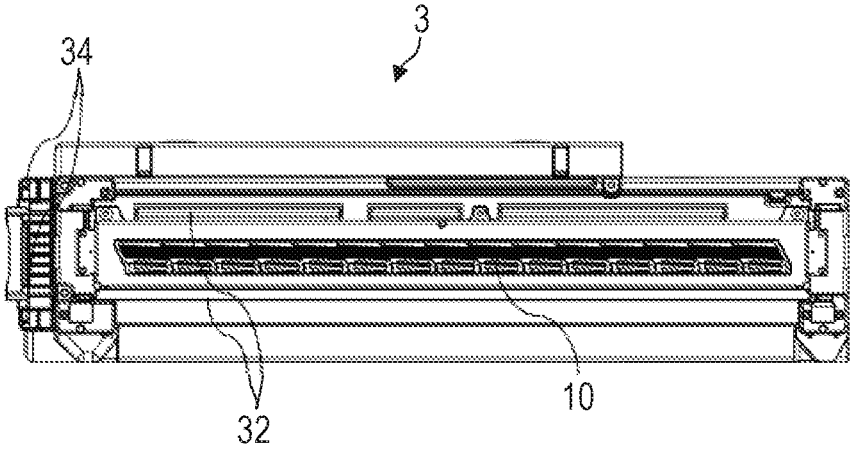

Subsequently, the liquid ejection head 3 according to this embodiment will be described by referring to the attached drawings. FIG. 4A illustrates a perspective view of the liquid ejection head 3, and FIG. 4B illustrates an A-arrow view in FIG. 4A. The liquid ejection head 3 is lengthy and has a plurality of recording element substrates 10 capable of ejecting the ink to the medium P conveyed by the conveyance portion 1. On the recording element substrate 10, ejection ports for the ink aligned from one end side to the other end side in its longitudinal direction, a recording element (not shown) for generating energy for ejecting the liquid, a pressure chamber (not shown) including this recording element therein and the like are formed. That is, the liquid ejection head 3 of this embodiment has a function of ejecting the ink in each color to the medium P conveyed along a short direction of the liquid ejection head 3 by the conveyance portion 1 as described above. In this embodiment, the plurality of recording element substrates 10 are arrayed linearly (inline) along the longitudinal direction of the liquid ejection head. As a result, a length in its short direction can be made smaller with respect to a surface on which the recording element substrates of the liquid ejection head 3 are provided, which enables not only size reduction of the liquid ejection head but also high-quality recording. A ratio of the length in the longitudinal direction to the short direction with respect to the surface on which the recording element substrate of the liquid ejection head 3 is provided can be 1:7 or more.

Moreover, on the liquid ejection head 3, a rail portion 32 (an example of a first rail portion) provided along the longitudinal direction and an engagement hole 34 (an example of an engaging portion or an engaged portion) on an end portion thereof are formed in order to attach the protective member 5 which will be described later. Technical meanings of the rail portion 32 and the engagement hole 34 will be described later.

The liquid ejection head 3 of this embodiment is configured such that the protective member 5 which will be described later is mounted at a predetermined position. Here, in this embodiment, a combination of the liquid ejection head 3 and the protective member 5 is referred to as a liquid ejection head unit 2 (see FIGS. 3A to 3E and the like). The liquid ejection head 3 of this embodiment is detachably attached to the main body of the liquid ejecting apparatus 1000. That is, the liquid ejection head 3 of this embodiment is mounted on the main body 1000A of the liquid ejecting apparatus 1000. Moreover, the liquid ejection head 3 mounted on the main body 1000A is connected to the main body 1000A through a communication cable (not shown).

[Configuration of Protective Member]

Figure 5A:
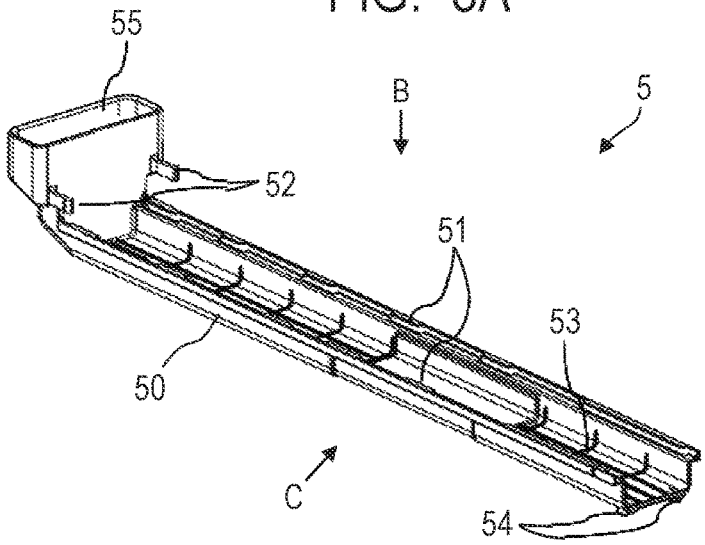
FIGS. 5A, 5B and 5C are a perspective view, a B-arrow view and a C-arrow view of the protective member of the embodiment.
Figure 5B:
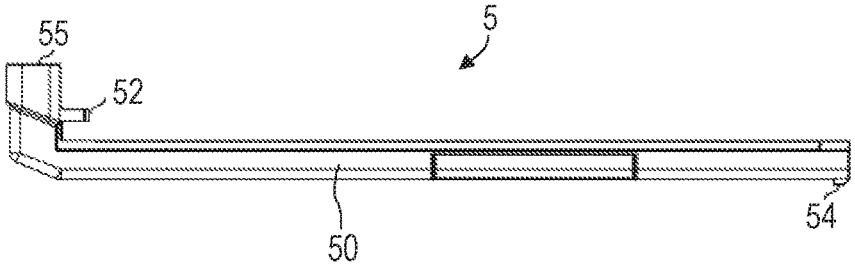
Figure 5C:
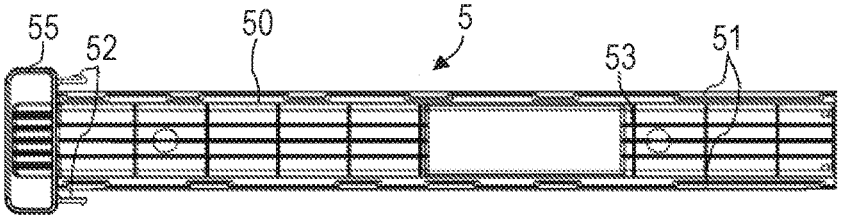

Subsequently, the protective member 5 of this embodiment will be described by referring to the drawings. FIG. 5A is a perspective view of the protective member 5, FIG. 5B is a C-arrow view of FIG. 5A, FIG. 5C is a B-arrow view of FIG. 5A. The protective member 5 of this embodiment has a covering member 50 (an example of a plate-shaped portion), a flange rail portion 51 (an example of a second rail portion), an engagement claw 52, a rib 53, a drop-preventing boss 54 (an example of another projection), and a handle 55.

Figure 3A:
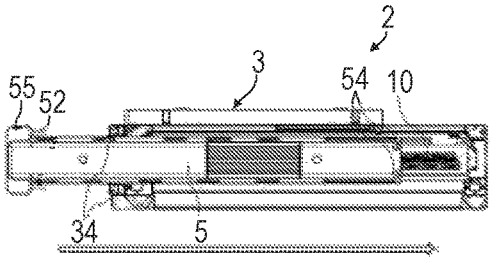
FIGS. 3A, 3B, 3C, 3D and 3E are views of a liquid ejection head and a protective member of the embodiment.
Figure 3C:
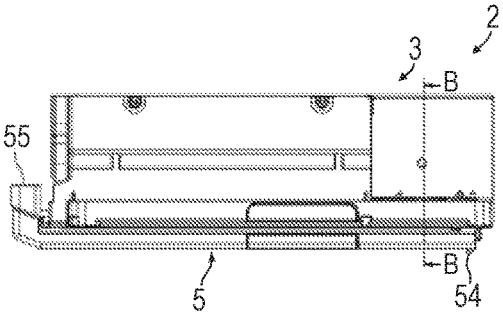
Figure 3B:
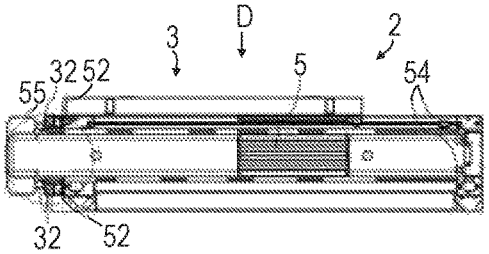
Figure 3D:
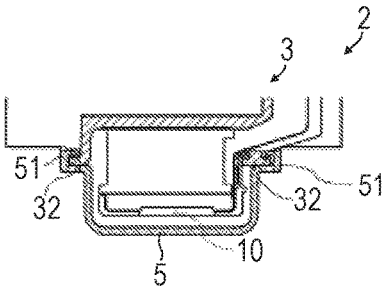

Here, the covering member 50 is lengthy and has a U-shaped sectional surface (see FIG. 3D). When the protective member 5 is attached to the liquid ejection head 3, the covering member 50 covers a (surface facing the medium P in a) recording element substrate 10 (see FIGS. 3A to 3E). The flange rail portion 51 is provided on both sides of the covering member 50 along the longitudinal direction of the covering member 50. The flange rail portions 51 are fitted in rail portions 32 provided on the liquid ejection head 3 and are made to slide with respect to each other (see FIG. 3D). The handle 55 is provided on one end side of the covering member 50. The engagement claw 52 is provided on the covering member 50 side in the handle 55. The engagement claw 52 (an example of the engaging portion or the engaged portion) is configured to be engaged with the engagement hole 34 of the liquid ejection head 3 (see FIGS. 3B and 3E). The rib 53 is formed on an inner peripheral side of the covering member 50. The drop-preventing boss 54 is provided on a side opposite to the side where the handle 55 is provided in the longitudinal direction of the covering member 50 and protrudes downward from a lower surface of the covering member 50.

The configurations of the liquid ejecting apparatus 1000 and the liquid ejection head unit 2 of this embodiment have been described. The other configurations will be described in description of mounting and removing operations of the liquid ejection head 3 which will be described later.

[Removing (Taking-Out) Operation and Effect of Liquid Ejection Head]

Subsequently, a removing (taking-out) operation of the liquid ejection head 3 from the main body 1000A of this embodiment will be described by referring to the drawings.

Figure 6A:
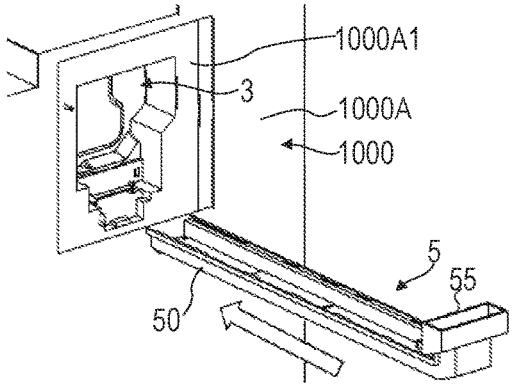
FIGS. 6A, 6B and 6C are views illustrating an operation of attaching and removing the protective member to/from the liquid ejection head of the embodiment.
Figure 6B:
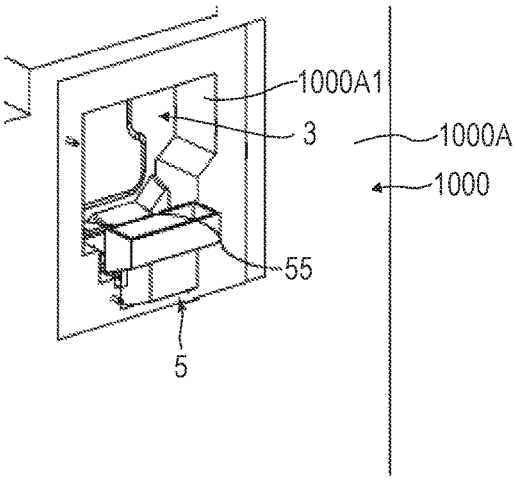
Figure 6C:
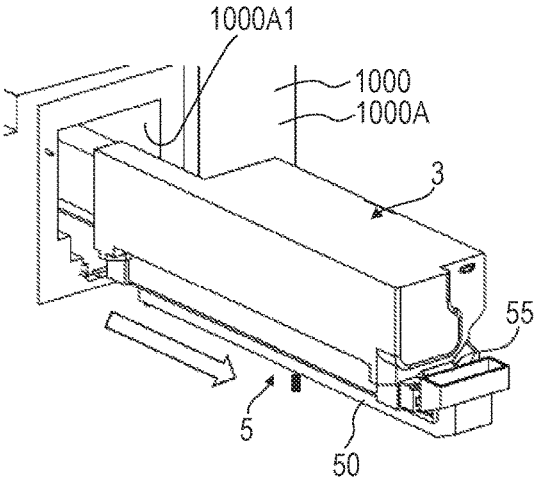

FIG. 6A illustrates a view in which the protective member 5 is inserted into the liquid ejection head 3 mounted on the main body 1000A. FIG. 6B illustrates a view of a state where the protective member 5 is fully attached to the liquid ejection head 3. FIG. 6C illustrates a view of a state where the liquid ejection head 3 (liquid ejection head unit 2) has been taken out of the main body 1000A. That is, FIGS. 6A to 6C are views illustrating a taking-out procedure of the liquid ejection head 3 mounted on the main body 1000A. Here, in this embodiment, the "state where the protective member 5 is fully attached to the liquid ejection head 3" means a state where the covering member 50 of the protective member 5 faces the facing surface of the recording element substrate 10 in a predetermined positional relationship. From another viewpoint, the "state where the protective member 5 is fully attached to the liquid ejection head 3" means a state where the protective member 5 is attached to the liquid ejection head 3 in the predetermined positional relationship.

Figure 3E:
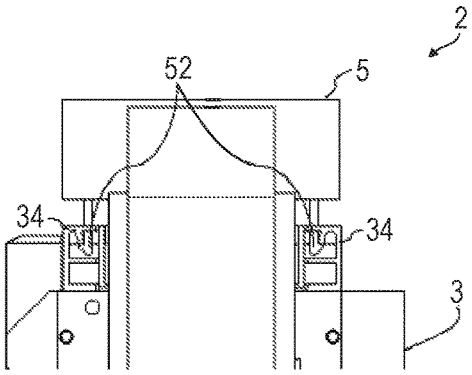

Moreover, FIG. 3A illustrates a view of a state of a process of attaching the protective member 5 to the liquid ejection head 3 when seen from the recording element substrate 10 side. FIG. 3B illustrates a view of a state where the protective member 5 is fully attached to the liquid ejection head 3. FIG. 3C is a D-arrow view in FIG. 3B, FIG. 3D is a B-B sectional view in FIG. 3C and FIG. 3E illustrates an enlarged view in a dotted line portion in FIG. 3B.

Hereinafter, the taking-out procedure of the liquid ejection head 3 mounted on the main body 1000A of the liquid ejecting apparatus 1000 will be described specifically.

First, as illustrated in FIG. 1A, the liquid ejection head 3 is fixed at an attachment position of the liquid ejection head 3 in the main body 1000A in a state mounted on the main body 1000A. In this state, the ink is ejected from the liquid ejection head 3, and recording is carried out on the medium such as paper. Hereinafter, a process of removing the liquid ejection head 3 from the liquid ejecting apparatus 1000 when the liquid ejection head 3 is to be replaced due to reasons such as a life or nonconformity of the liquid ejection head 3 will be described.

Subsequently, as illustrated in FIG. 6A, a worker inserts the protective member 5 into a space (a hatched portion in FIG. 1B; a space assumed to be an occupied space of the protective member 5) between the liquid ejection head 3 and the main body 1000A. In this case, as illustrated in FIG. 3D, after the flange rail portion 51 and the rail portion 32 of the liquid ejection head 3 are fitted together, the protective member 5 is inserted into the space between the liquid ejection head 3 and the main body 1000A while being slid along the longitudinal direction of the liquid ejection head 3.

Then, when the protective member 5 is completely inserted, the protective member 5 is brought into a state where the protective member 5 is fully attached to the liquid ejection head 3. In this case, as illustrated in FIGS. 3B and 3E, the engagement claw 52 of the protective member 5 is fitted in the engagement hole 34 of the liquid ejection head 3. Thus, in this embodiment, when the liquid ejection head 3 (or the liquid ejection head unit 2) is to be removed from the main body 1000A, the protective member 5 is not easily removed from the liquid ejection head 3. As a result, the liquid ejection head unit 2 can be taken out in the state where the liquid ejection head 3 and the protective member 5 are integrated.

Figure 7A:
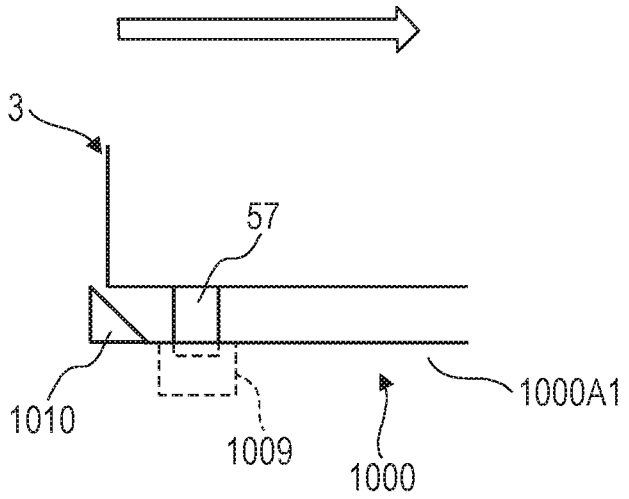
FIGS. 7A and 7B are views illustrating a state where the liquid ejection head of the embodiment is positioned and fixed to an apparatus body and a state where the positioning and fixing are released.
Figure 7B:
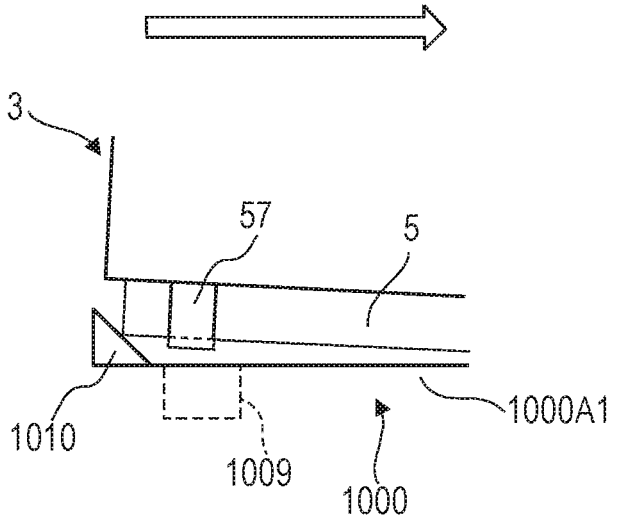

Moreover, when the protective member 5 is fully attached to the liquid ejection head 3, the positioning fixation between the liquid ejection head 3 and the main body 1000A is released. Hereinafter, a releasing structure (fixation releasing structure) of positioning fixation will be described. Here, the fixation releasing structure is a structure combining at least the liquid ejection head unit 2 and a fixing hole 1009 which is a recess part in the main body 1000A. FIGS. 7A and 7B are schematic views illustrating a releasing mechanism by which the positioning fixation between the liquid ejection head 3 and the main body 1000A is released by attaching the protective member 5. FIG. 7A is a schematic view illustrating a state where the liquid ejection head 3 and the main body 1000A are positioned/fixed, and FIG. 7B is a schematic view illustrating a state where the positioning fixation between the liquid ejection head 3 and the main body 1000A is released by attaching the protective member 5 to the liquid ejection head 3.

As illustrated in FIG. 7A, the liquid ejection head 3 is positioned/fixed by engaging a fixing boss 57 which is a projection of the liquid ejection head 3 (an example of a first engagement portion) with the fixing hole 1009 (an example of a second engagement portion) of the main body 1000A. That is, movement of the liquid ejection head 3 in the longitudinal direction is limited. Specifically, by fitting the fixing boss 57 in the fixing hole 1009 of the main body 1000A, movement of the liquid ejection head 3 in the longitudinal direction is limited. Then, as illustrated in FIG. 7B, when the protective member 5 is fully attached to the liquid ejection head 3, the liquid ejection head 3 is raised (moved upward) by contact between an inclination surface of the inclined portion 1010 of the main body 1000A and (a tip end of) the liquid ejection head 3, and the fixing boss 57 is removed from the fixing hole 1009. As a result, the positioning fixation is released. That is, when the protective member 5 is inserted through the opening 1000A1 of the main body 1000A and is attached to the liquid ejection head 3 in the predetermined positional relationship, one of the fixing boss 57 and the fixing hole 1009 is relatively moved to a position not overlapped with the other in a vertical direction. As a result, the liquid ejection head 3 can be pulled out (taken out) of the main body 1000A. That is, according to this embodiment, as the protective member 5 is attached to the liquid ejection head 3 fixed to the main body 1000A, fixation of the liquid ejection head 3 can be released with a simple mechanism.

The handle 55 only needs to have a shape that can pull out the liquid ejection head 3 (a shape that can be gripped by the worker).

Figure 8A:
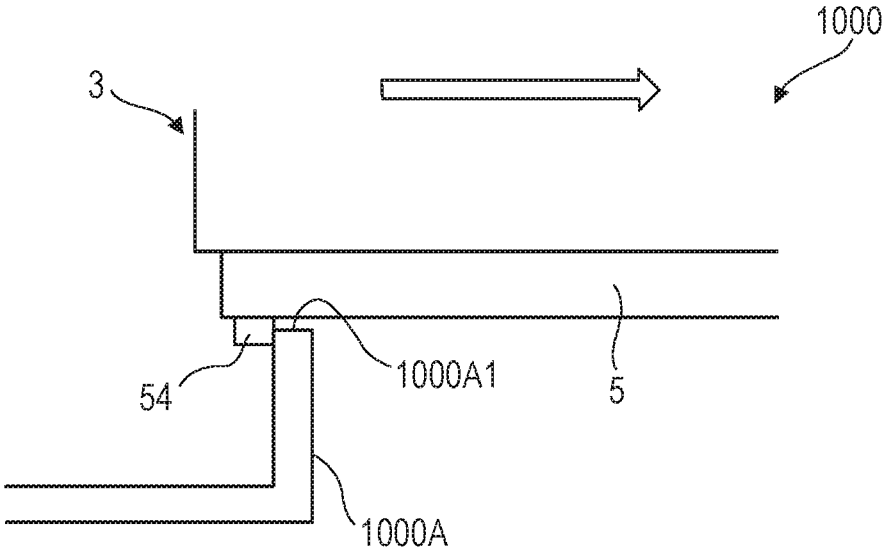
FIGS. 8A and 8B are views illustrating hooking of a drop-preventing boss of the protective member of the embodiment by an opening of the apparatus body.
Figure 8B:
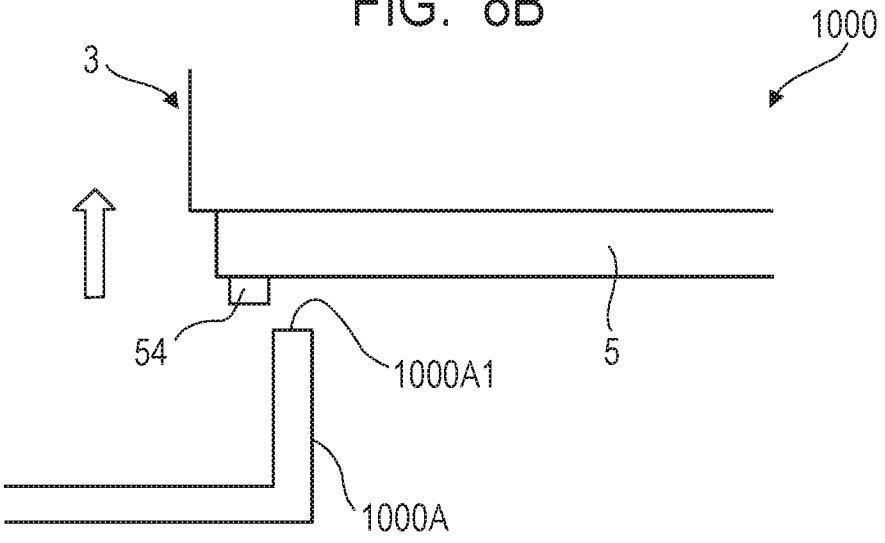

When the liquid ejection head 3 is pulled out of the main body 1000A, if the worker pulls out the liquid ejection head 3 vigorously, the liquid ejection head 3 could drop and cause ink contamination or a failure in the liquid ejection head 3. Thus, in this embodiment, as illustrated in FIGS. 8A and 8B, the drop-preventing boss 54 (an example of another projection) is provided on the protective member 5. Thus, when the liquid ejection head 3 is pulled out, the drop-preventing boss 54 has a configuration that the drop-preventing boss 54 is hooked by the opening 1000A1 of the main body 1000A once, and the liquid ejection head 3 cannot be pulled out vigorously.

FIGS. 8A and 8B are views illustrating a state where the drop-preventing boss 54 and the liquid ejecting apparatus 1000 are hooked by each other and illustrate schematic views after the hooked state (FIG. 8A), and when the hooked state is released (FIG. 8B). For example, if the worker pulls out the liquid ejection head 3, the drop-preventing boss 54 is engaged with the main body 1000A, and the liquid ejection head 3 cannot be pulled out of the main body 1000A once. Specifically, the drop-preventing boss 54 is hooked by an edge of the opening of the main body 1000A, and the liquid ejection head 3 cannot be pulled out of the main body 1000A once. Subsequently, the worker carries out a pulling-out operation while shaking the liquid ejection head unit 2, whereby the engagement between the drop-preventing boss 54 of the liquid ejection head 3 with the main body 1000A is released. As a result, the liquid ejection head 3 is pulled out of the main body 1000A.

In this embodiment, the drop-preventing boss 54 is formed of two members protruding from a bottom surface of the covering member 50 of the protective member 5 (see FIG. 5A). However, this disclosure is not limited to this embodiment, but the structure only needs to be such that the drop-preventing boss 54 is engaged with the main body 1000A such as a configuration in which the drop-preventing boss 54 is provided on a side surface and hooked by the main body 1000A, for example. That is, the drop-preventing boss 54 only needs to protrude outward from the protective member 5 and to be engaged with the main body 1000A.

In this embodiment, as illustrated in FIGS. 3B to 3D, when the protective member 5 is fully attached to the liquid ejection head 3, the entire recording element substrate 10 is fully covered by the protective member 5. Thus, when the liquid ejection head 3 is to be taken out of the main body 1000A, contact (of the hand of the worker, for example) with the recording element substrate 10 can be prevented. With that, contamination from the ink adhering to the recording element substrate 10, contamination by scattering of the ink to the floor or the like, a failure caused by the contact with the recording element substrate 10 and the like can be suppressed.

Moreover, in this embodiment as illustrated in FIG. 5C, the ribs 53 are formed in a lattice state on portions facing the recording element substrate 10 of the liquid ejection head 3 in the protective member 5 so as to have a structure in which the ink dripping from the recording element substrate 10 and falling collects inside the protective member 5. Thus, even if the liquid ejection head 3 is inclined when the liquid ejection head 3 is to be taken out, outflow of the ink from the protective member 5 to an outer side can be suppressed. A width, a height, an interval and the like of the ribs 53 may be any shape as long as it is the shape which can collect the ink to some degree.

When the protective member 5 is made to slide for attachment, the flange rail portion 51 of the protective member 5 and the rail portion 32 of the liquid ejection head 3 slide in contact with each other. At that time, if the protective member 5 is electrically charged, there is a concern that the charged static electricity is discharged to the recording element substrate 10, and the liquid ejection head 3 fails. Thus, in order to prevent the failure by discharge, a material of the protective member 5 can be configured by antistatic material, for example.

Figure 11A:
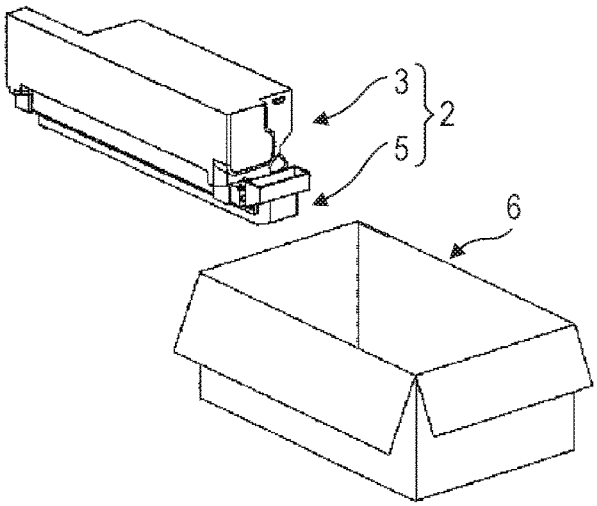
FIGS. 11A, 11B and 11C are views illustrating a state where the used liquid ejection head is accommodated in a recovering material.
Figure 11B:
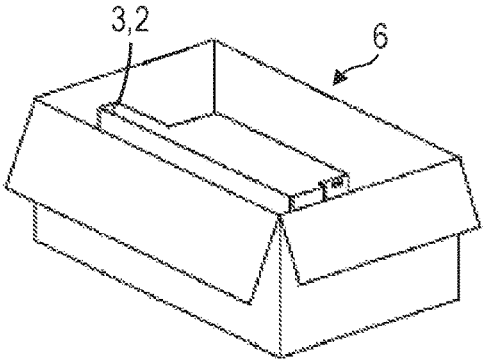
Figure 11C:
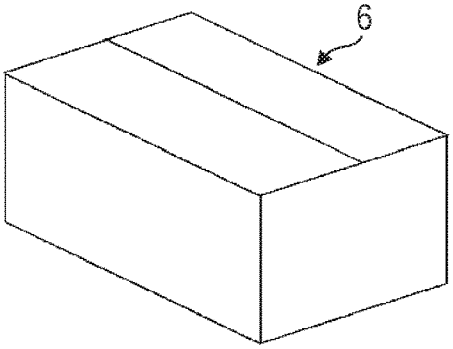

When the liquid ejection head 3 is to be replaced, recovery of the used liquid ejection head 3 is needed. Here, FIGS. 11A to 11C are views illustrating a state where the used liquid ejection head 3 is taken out of the main body 1000A by the aforementioned method and accommodated in a recovery material 6 (recovery box). Here, the liquid ejection head 3 taken out of the main body 1000A is accommodated in the recovery material 6 with the protective member 5 attached (in a state of the liquid ejection head unit 2). Thus, even if the ink is scattered from the recording element substrate 10 during transportation, the ink can be received by the protective member 5. With that, the contamination on the recovery material 6 by the ink or the contamination of the liquid ejection head 3 itself can be suppressed, and ink contamination on other logistic products by the ink adhering to the recovery material 6 during the logistics can be prevented. In this embodiment, the recovery material 6 has a form of a box, but the recovery material 6 does not have to be a box as long as it is in a form capable of accommodating the liquid ejection head 3 for logistics. For example, as another example of the recovery material 6, other configurations such as a bag, a combination of a bag and a box and the like may be used.

<First Variation>

Hereinafter, in a first variation, a portion different from this embodiment will be described. In the description of this variation, the same reference numerals as those of the portions in this embodiment are used for the portions with the same configuration.

In this embodiment, the description was made such that the protective member 5 is made to slide with respect to the liquid ejection head 3, and the rail portion 32 of the liquid ejection head 3 and the flange rail portion 51 of the protective member 5 are fitted together (see FIGS. 3A to 3E and FIGS. 6A to 6C). However, the structure in which the protective member 5 is slid and attached to the liquid ejection head 3 is not limited to the rail shape illustrated in this embodiment.

Figure 9:
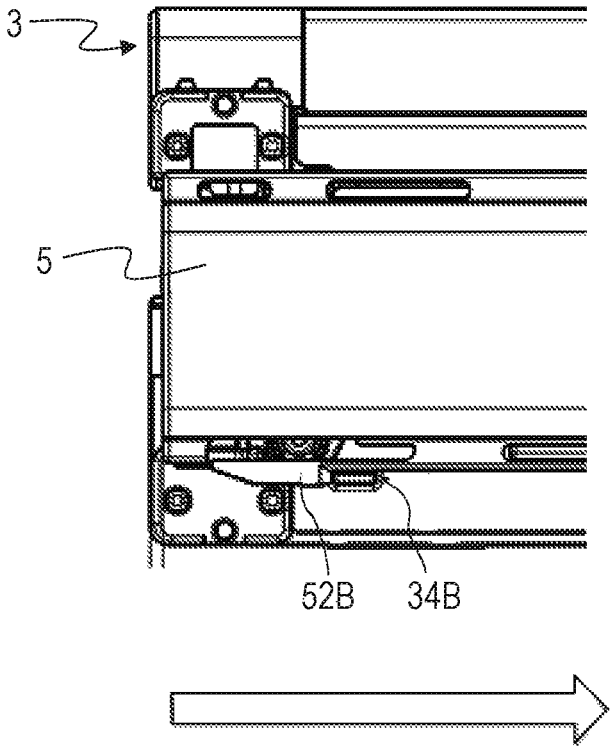
FIG. 9 is a view of a liquid ejection head and a protective member of a first variation.

For example, the configuration may be such that the shapes (projection and recess) of the rail portion 32 of the liquid ejection head 3 and the flange rail portion 51 of the protective member 5 may be vice versa. Thus, the shape (or the structure) does not matter as long as the protective member 5 is slidable with respect to the liquid ejection head 3 and they have shapes (or the structures) fitted with each other. That is, the configuration for fixing the protective member 5 to the liquid ejection head 3 is not limited to the configuration of this embodiment but may be any configuration as long as it is a configuration of fixing the protective member 5 to the liquid ejection head 3 when the protective member 5 is attached to the liquid ejection head 3. For example, as in the first variation illustrated in FIG. 9, it may be such a form that an engagement claw 52B in an elastic latch lever form is provided on a tip end side of the protective member 5, an engagement rib 34B is provided on the liquid ejection head 3, and after the both are engaged by sliding insertion of the protective member 5, the liquid ejection head unit 2 is taken out.

<Second Variation>

Hereinafter, in a second variation, a portion different from this embodiment will be described. In the description of this variation, the same reference numerals as those of the portions in this embodiment are used for the portions with the same configuration.

A releasing structure of positioning fixation (fixation releasing structure) between the liquid ejection head 3 and the main body 1000A is not limited to the configuration of this embodiment but may be any configuration as long as it is a structure in which the positioning fixation is released when the protective member 5 is attached to the liquid ejection head 3.

Figure 10A:
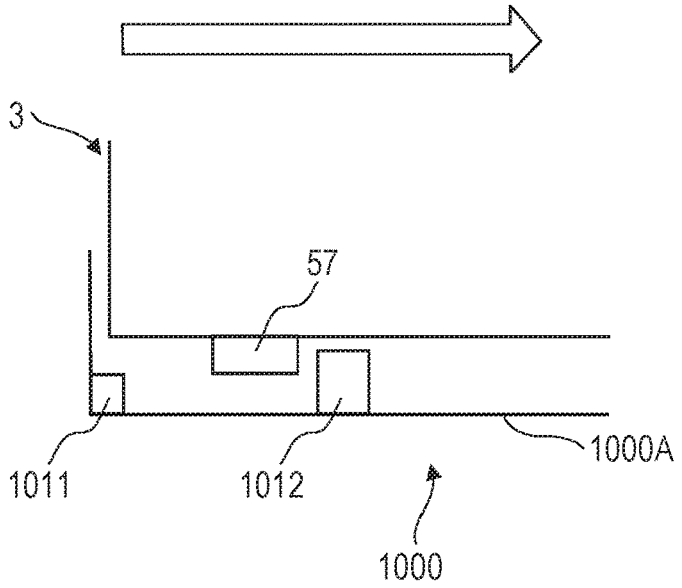
FIGS. 10A and 10B are views illustrating a state where the liquid ejection head of a second variation is positioned and fixed to an apparatus body and a state where the positioning and fixing are released.
Figure 10B:
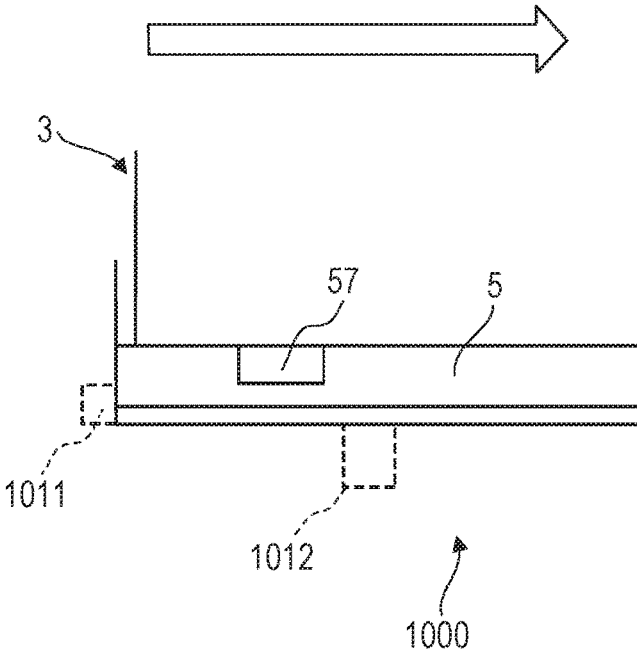

For example, FIGS. 10A and 10B illustrate a variation (second variation) of the fixation releasing structure. In the case of this variation, a button 1011 and an obstruction wall 1012 (an example of the second engagement portion and a wall) are provided on (the main body 1000A of) the liquid ejecting apparatus 1000. The obstruction wall 1012 is arranged closer to a downstream side (opening side) of a removing direction of the liquid ejection head 3 with respect to the fixing boss 57 than the fixing boss 57 (an example of the first engagement portion) of the liquid ejection head 3 and is a wall being brought into contact with the fixing boss 57 and limiting movement of the fixing boss 57 in the removing direction. That is, in the case of this variation, since the fixing boss 57 and the obstruction wall 1012 are brought into contact and cannot be pulled out, the liquid ejection head 3 is positioned/fixed. The button 1011 is arranged closer to an upstream side (side opposite to the opening side) of the removing direction of the liquid ejection head 3 than the obstruction wall 1012. When the button 1011 is pressed, it electrically moves the obstruction wall 1012 downward. When the protective member 5 is fully attached to the liquid ejection head 3, the button 1011 is pressed by (the tip end of) the protective member 5, and the obstruction wall 1012 is relatively moved to a position where the obstruction wall 1012 is not in contact with the fixing boss 57 (a position not overlapped in the vertical direction). As a result, the positioning/fixation of the liquid ejection head 3 is released, and the liquid ejection head 3 can be pulled out of the main body 1000A.

<Third Variation>

Hereinafter, in a third variation, a portion different from this embodiment will be described. In the description of this variation, the same reference numerals as those of the portions in this embodiment are used for the portions with the same configuration.

Figure 12A:
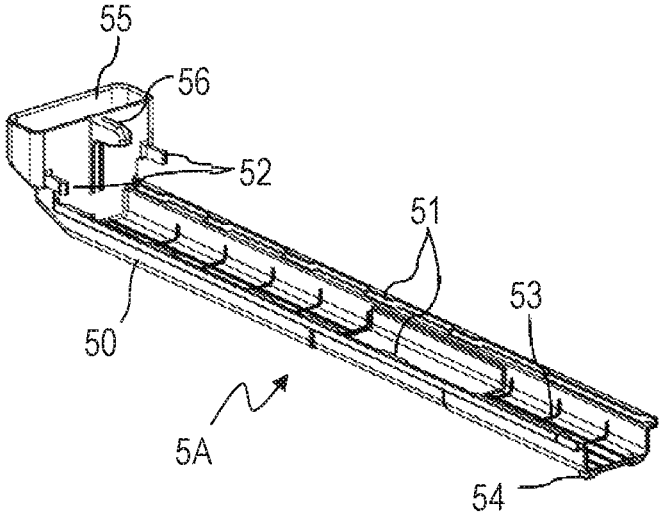
FIGS. 12A and 12B are views of a liquid ejection head and a protective member of a third variation.
Figure 12B:
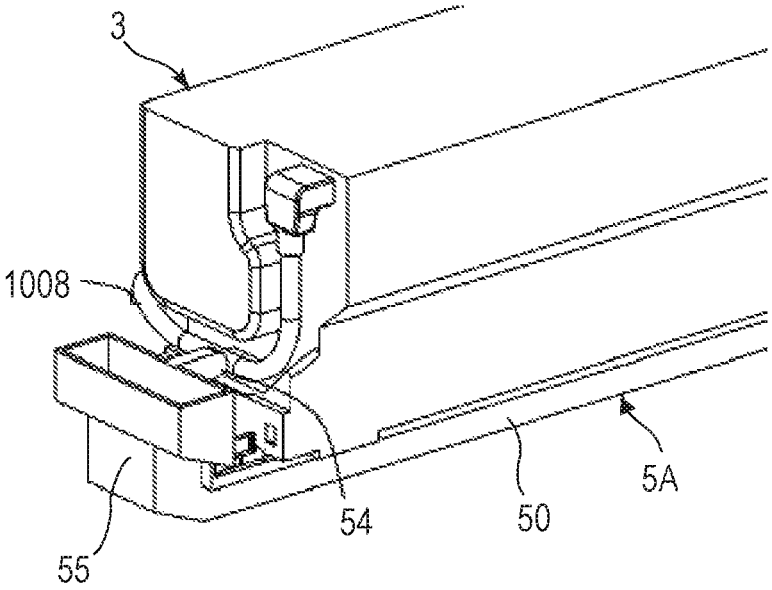

In this variation, as illustrated in FIG. 12B, the liquid ejection head 3 in a state mounted on the main body 1000A is connected to the main body 1000A by a communication cable 1008 (an example of a cable). Here, the fixation releasing structure of this variation is a structure in which the liquid ejection head unit 2 including at least a protective member 5A and the communication cable 1008 are combined.

If the liquid ejection head 3 with the communication cable 1008 still connected is pulled out, there is a concern of falling or a failure of the liquid ejecting apparatus 1000 (or its components).

Here, FIG. 12A illustrates a perspective view of the protective member 5A in a third variation. In addition to the configuration in this embodiment (see FIG. 5A), the protective member 5A includes a projection 56 protruding from a surface of the handle 55 on the covering member 50 side. Moreover, FIG. 12B illustrates a view of a state where the protective member 5 is inserted in a state where the communication cable 1008 is still connected to the liquid ejection head 3.

In this variation, when the protective member 5A with the communication cable 1008 still attached to the liquid ejection head 3 is to be attached to the liquid ejection head 3, the projection 56 of the protective member 5A interferes with a part of the communication cable 1008. That is, in this embodiment, when the communication cable 1008 is attached to the liquid ejection head 3, a part of the communication cable 1008 is arranged in an occupied space of the protective member 5A mounted on the liquid ejection head 3 in the predetermined positional relationship. Thus, in the case of this variation, since the protective member 5A cannot be fully attached to the liquid ejection head 3 and thus, the engagement state between the liquid ejection head 3 and the main body 1000A cannot be released, the liquid ejection head 3 cannot be taken out of the main body 1000A. Thus, in order to fully attach the protective member 5A to the liquid ejection head 3, the communication cable 1008 needs to be pulled out of the liquid ejection head 3 in advance. With that, in the state where the liquid ejection head 3 is connected to the communication cable 1008, the liquid ejection head 3 cannot be pulled out. By means of this configuration, when the liquid ejection head 3 is to be taken out of the main body 1000A, forgetting to pull out the communication cable 1008 can be suppressed. As a result, in this variation, a failure or falling of the liquid ejecting apparatus 1000 can be prevented.

In this variation, it is assumed that the communication cable 1008 and the projection 56 of the protective member 5A buffer each other. However, the projection 56 does not have to be provided as long as it is configured such that a portion other than the projection 56 in the protective member 5A interferes with the communication cable 1008 when the protective member 5A is to be attached to the liquid ejection head 3 in the state connected to the communication cable 1008.

As described above, the aforementioned embodiment of this disclosure has been described as an example, but the technical scope of this disclosure is not limited to this embodiment.

In this embodiment, a thermal method of ejecting a liquid by generating air bubbles by a heat generating element is employed as an example, but this disclosure can be applied also to liquid ejection heads employing a piezo method and other various liquid ejection methods. The liquid ejection head configuration with multi-color one-body has been described, but this is not limiting, and it may be a liquid ejection head form ejecting a single color.

This embodiment is the liquid ejecting apparatus 1000 in the form in which the liquid such as ink is circulated between the tank and the liquid ejection head, that is, between an inside of the pressure chamber and an outside of the pressure chamber. However, it may be such a form that the ink in the pressure chamber is made to flow by providing two tanks on the upstream side and the downstream side of the liquid ejection head and by flowing the ink from one of the tanks to the other tank without circulating the ink, for example.

The head unit of this disclosure provides a small-sized liquid ejection head unit capable of being removed from the main body without exposing the ejection port when the liquid ejection head is removed from the main body of the liquid ejecting apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133992, filed Jul. 7, 2017, which is hereby incorporated by reference herein in its entirety.

What is claimed is:

1. A liquid ejection head unit comprising a page-wide type liquid ejection head including an ejection port surface on which an ejection port for ejecting a liquid is provided, the liquid ejection head being detachably attached to a liquid ejecting apparatus, and a protective member detachably attached to the liquid ejection head, wherein the liquid ejection head includes a first rail portion along a longitudinal direction of the liquid ejection head, and the protective member includes a second rail portion along a longitudinal direction of the protective member; and the second rail portion of the protective member is brought into contact with the first rail portion of the liquid ejection head mounted on the liquid ejecting apparatus, the ejection port surface is covered by sliding the protective member in a first direction along the longitudinal direction of the liquid ejection head, and after the protective member is attached to the liquid ejection head, the liquid ejection head and the protective member are both moved in a second direction opposite to the first direction to be removed from the liquid ejecting apparatus.

2. The liquid ejection head unit according to claim 1, wherein one of an engaging portion and an engaged portion is formed on the liquid ejection head;

another of the engaging portion and the engaged portion is provided on the protective member; and after the protective member covers the ejection port surface, the engaging portion and the engaged portion are engaged.

3. The liquid ejection head unit according to claim 1, wherein the liquid ejection head includes a recording element generating energy for ejecting a liquid and a pressure chamber including the recording element therein, and the liquid in the pressure chamber is circulated with an outside of the pressure chamber.

4. A liquid ejecting apparatus comprising:

the liquid ejection head unit according to claim 1 in which a first engagement portion is provided in the liquid ejection head; and a second engagement portion provided on a main body of the liquid ejecting apparatus and adapted to be engaged with the first engagement portion and to limit removal of the liquid ejection head, wherein the engagement between the first engagement portion and the second engagement portion is released by insertion of the protective member into the liquid ejection head fixed to the main body.

5. The liquid ejecting apparatus according to claim 4, wherein the first engagement portion is a projecting portion provided on the liquid ejection head and the second engagement portion is a recess portion provided on the main body; and an inclined surface with which the protective member is brought into contact is provided closer to an upstream side with respect to a removing direction of the liquid ejection head than the recess portion in the main body.

6. The liquid ejecting apparatus according to claim 4, wherein the first engagement portion is a projecting portion provided on the liquid ejection head and the second engagement portion is a wall provided on the main body, arranged closer to a downstream side with respect to a removing direction of the projecting portion than the projecting portion, the wall limiting movement of the projecting portion in the removing direction of the liquid ejection head by being brought into contact with the projecting portion.

7. The liquid ejecting apparatus according to claim 6, wherein a button adapted to move the wall downward by being pressed onto a tip end of the protective member is arranged closer to an upstream side with respect to the removing direction than the wall in the main body.

8. A liquid ejecting apparatus comprising:

the liquid ejection head unit according to claim 1; and a cable attached to the liquid ejection head provided on a main body of the liquid ejecting apparatus and fixed to the main body, wherein when the protective member is attached in a state where the cable is attached to the liquid ejection head, the cable and the protective member are brought into contact with each other.

9. A liquid ejecting apparatus comprising:

the liquid ejection head unit according to claim 1 in which a projection protruding outward is provided on a portion on an upstream side with respect to a removing direction in the protective member; and a main body in which an opening through which the liquid ejection head is attached/detached is formed, wherein the projection is engaged with an edge of the opening when the liquid ejection head unit is moved from the main body along the removing direction of the liquid ejection head.

* * * * *